US007779742B2

(12) United States Patent
Benyami et al.

(10) Patent No.: US 7,779,742 B2
(45) Date of Patent: Aug. 24, 2010

(54) ARMOR MODULE

(75) Inventors: Moshe Benyami, Haifa (IL); Samuel Friling, Kiriat Ata (IL); Sony Helvanyo, Kirvat Haim (IL)

(73) Assignee: Rafael Armament Development Authority Ltd., Haifa (IL)

( * ) Notice: Subject to any disclaimer, the term of this patent is extended or adjusted under 35 U.S.C. 154(b) by 0 days.

(21) Appl. No.: 11/479,759

(22) Filed: Jun. 30, 2006

(65) Prior Publication Data

US 2007/0113730 A1 May 24, 2007

Related U.S. Application Data

(63) Continuation of application No. 10/285,373, filed on Oct. 31, 2002, now Pat. No. 7,080,587.

(30) Foreign Application Priority Data

Jan. 29, 2002 (IL) ..... 147881

(51) Int. Cl.
*F41H 5/007* (2006.01)
*F41H 5/04* (2006.01)

(52) U.S. Cl. ..... 89/36.17; 89/36.02; 89/36.08

(58) Field of Classification Search ..... 89/36.17, 89/36.02, 36.08
See application file for complete search history.

(56) References Cited

U.S. PATENT DOCUMENTS

| | | | | |
|---|---|---|---|---|
| 1,508,421 | A | 9/1924 | Taegen | |
| 2,318,301 | A | 5/1943 | Eger | |
| 2,376,331 | A | 5/1945 | Abrams | |
| 2,477,852 | A | 8/1949 | Bacon | |
| 3,699,842 | A | 10/1972 | Grewing et al. | |
| 3,765,299 | A | 10/1973 | Pagano et al. | |
| 3,776,094 | A | 12/1973 | Gilles et al. | |
| 4,036,104 | A | 7/1977 | Pagano et al. | |
| 4,351,558 | A | 9/1982 | Mueller | |
| 4,555,991 | A | 12/1985 | Bellezza | |
| 4,741,244 | A | 5/1988 | Ratner et al. | |
| 4,867,077 | A * | 9/1989 | Marlow et al. | 109/36 |
| 4,895,063 | A | 1/1990 | Marlow et al. | |
| 4,957,034 | A | 9/1990 | Tasdemiroglu | |

(Continued)

FOREIGN PATENT DOCUMENTS

DE 25 56 722 7/1988

(Continued)

OTHER PUBLICATIONS

Communication pursuant to Article 94(3) EPC, dated Mar. 25, 2009, for the corresponding European Application EP 02 024 444.8.

*Primary Examiner*—Stephen M Johnson
(74) *Attorney, Agent, or Firm*—Katten Muchin Rosenman LLP

(57) ABSTRACT

An armor module having a rigid casing having a front face, a top face and a bottom face, and a plurality of multi-layer planner cassettes fixedly mounted within the casing. Each cassette has a top base plate and a bottom base plate, sandwiching between them at least a one other layer. The top base plate of an uppermost cassette constitutes the top face of the casing, and a bottom base plate of a lowermost cassette constitutes the bottom face of the casing.

28 Claims, 3 Drawing Sheets

U.S. PATENT DOCUMENTS

| | | | | | |
|---|---|---|---|---|---|
| 5,012,721 | A | | 5/1991 | Medin et al. | |
| 5,070,764 | A | | 12/1991 | Shevach et al. | |
| 5,214,235 | A | * | 5/1993 | Froeschner | 89/36.13 |
| 5,217,185 | A | | 6/1993 | Rucker | |
| 5,370,034 | A | * | 12/1994 | Turner et al. | 89/36.02 |
| 5,413,027 | A | * | 5/1995 | Mixon | 89/36.17 |
| 5,452,641 | A | | 9/1995 | Kariya | |
| 5,637,824 | A | | 6/1997 | Benyami | |
| 5,641,933 | A | | 6/1997 | Kim | |
| 5,670,734 | A | * | 9/1997 | Middione et al. | 89/36.08 |
| 5,824,941 | A | * | 10/1998 | Knapper | 89/36.17 |
| 5,876,831 | A | | 3/1999 | Rawal | |
| 5,880,394 | A | | 3/1999 | Kim | |
| 6,532,857 | B1 | | 3/2003 | Shih et al. | |
| 2004/0237765 | A1 | * | 12/2004 | Schluter et al. | 89/36.17 |
| 2007/0039837 | A1 | | 2/2007 | Hanina et al. | |

FOREIGN PATENT DOCUMENTS

| | | |
|---|---|---|
| DE | 42 37 798 | 5/1994 |
| DE | 43 97 245 | 4/1995 |
| DE | 197 07 160 | 10/1998 |
| DE | 199 56 197 | 6/2001 |
| EP | 0 041 271 | 12/1981 |
| EP | 0 860 678 | 2/1998 |
| FR | 2 734 896 | 12/1996 |
| GB | 2191276 | 12/1987 |
| GB | 2 191 275 | 12/1989 |
| JP | 6-273095 | 9/1994 |
| WO | WO 91/12483 | 8/1991 |
| WO | WO 94/20811 | 9/1994 |
| WO | WO 01/38817 | 5/2001 |

* cited by examiner

ARMOR MODULE

CROSS-REFERENCE TO RELATED APPLICATIONS

This application is a continuation of and claims priority to U.S. patent application Ser. No. 10/285,373 filed on Oct. 31, 2002 and now U.S. Pat. No. 7,080,587, and which claims priority to Israeli Application 147881 filed Jan. 29, 2002. These applications are hereby incorporated by reference in their entirety.

FIELD OF THE INVENTION

The present invention is generally in the field of an armor module to be attached on the outside of a body liable to be exposed to attack by projectiles, e.g. shaped-charged warheads and kinetic energy projectiles. Examples of bodies protectable by armor models in accordance with the present invention are, for example, land vehicles such as battle tanks, armored personnel carriers, armored fighting vehicles, armored, self-propelled guns; static structures such as buildings, above-ground portions of bunkers, containers of various nature, for the storage of fuel, chemicals, ammunitions, etc.

In particular, the present invention is concerned with the casing of such an armor module.

BACKGROUND OF THE INVENTION

A large variety of patents are concerned with the type of protection offered by an armor module namely reactive armors or passive armors. At times, there are provided combined reactive and passive armor elements.

Such armors are disclosed, for example, in U.S. Pat. Nos. 2,318,301, 4,741,244, 5,070,764, 5,637,824 and German Publication 4,237,798A1.

Prior art armor assemblies disclose an armor assembly comprising a housing (often referred to in the art interchangeably as "a tile", "a box", "a module", "casing", etc.), with one or more cassettes fixedly received in the housing in a position corresponding with an anticipated oncoming projectile.

The one or more cassettes received within the casing are usually comprised of several layers having two outer members made of an inert material, e.g. a metal plate, sandwiching between them at least one layer of explosive material, at times with several other inert materials disposed in between. Typically, the cassettes are so arranged that the axis of an impinging projectile and of a jet formed upon deformation thereof generates with the surface of the wall's structure an acute angle of about 45°.

Casings of armor modules as known heretofore typically have a rectangle section as illustrated for example in the above-mentioned U.S. Pat. Nos. 2,381,301, 5,070,764 and in the German Publication 4,237,798A1.

It is, however, appreciated that the casing is in fact a parasite agent as far as overall weight of the armor module is concerned, since the active components of the armor module are the cassettes (reactive or passive or any combination thereof).

The arrangement of cassettes extending askew with respect to an axes of the housing has two significant drawbacks. First, adjacent top and bottom edges of a housing, the cassettes are significantly short and do not provide sufficient ballistic length, i.e. effective minimal length of the cassettes required for efficiently destroying/stopping a charged-shape projectile. This drawback is at times referred to as an end effect. As a result, when the length of an extreme top or extreme bottom cassette is extended so as to provide the above-mentioned minimum effective length, the armor module becomes significantly larger and thus heavier as a result of increase in dimension of the housing.

A second disadvantage of the heretofore known modules is such that an essentially horizontal gap existing between neighboring modules when two modules are successively mounted on top of one another, accumulates to the end effect of an armor module.

It is an object of the present invention to provide a novel armor module comprising a new sign of a housing which overcomes the above-mentioned drawbacks whilst not deteriorating the overall ballistic performances.

SUMMARY OF THE INVENTION

In accordance with the present invention there is provided an armor module comprising a rigid casing having a front face, a top face and a bottom face, and a plurality of multi-layer planner cassettes fixedly mounted within the casing; each cassette having a top base plate and a bottom base plate, sandwiching between them at least one other layer; wherein the top base plate of an uppermost cassette constitutes the top face of the casing, and a bottom base plate of a lowermost cassette constitutes the bottom face of the casing.

A second aspect of the invention is concerned with a method of protecting a body against projectiles, the method comprises the steps of:

Fitting the body on an outside thereof with at least one armor module for protection against said charge, said armor module comprises a casing having a front face, a top face and a bottom face, and a plurality of multi-layer planner cassettes fixedly mounted within the casing; each cassette having a top base plate and a bottom base plate, sandwiching between them at least a one other layer; wherein the top base plate of an uppermost cassette constitutes the top face of the casing, and a bottom base plate off a lowermost cassette constitutes the bottom face of the casing, where said front face faces an oncoming projectile.

Still a further aspect of the invention is concerned with a casing for an armor module, said casing made of a rigid material and having a front face, a top face and a bottom face, and a plurality of multi-layer planner cassettes fixedly mounted within the casing; each cassette having a top base plate and a bottom base plate, sandwiching between them at least one other layer; wherein the top base plate of an uppermost cassette constitutes the top face of the casing, and a bottom base plate off a lowermost cassette constitutes the bottom face of the casing.

The casing is made of a rigid material, e.g. metal or composite material and may be made in different configurations. For example, the top and bottom faces may be parallel to one another or, where the casing further comprises a rear face, the front and rear faces may be parallel to one another.

In accordance with one particular embodiment, the casing has a parallelogram section and by a modification thereof, the casing has a section of a parallelogram with one or both of an opposing top and a bottom edge, being truncated, for increasing durability of the casing.

It is highly desirable that an armor, in accordance with the present invention be an add-on type suitable for retro-fit on a body.

BRIEF DESCRIPTION OF THE DRAWINGS

For better understanding the invention and to see how it may be carried out in practice, some embodiments will now be described, by way of non-limiting examples only, with reference to the accompanying drawings, in which.

DETAILED DESCRIPTION OF SPECIFIC EMBODIMENTS

Figure 1A:
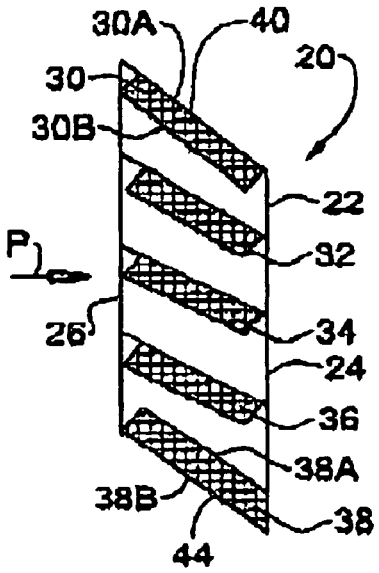
FIGS. 1A-1D are sectional views of different armor modules in accordance with different embodiments of the invention.

FIG. 1A illustrates a longitudinal section through an armor module in accordance with the present invention generally designated 20. The armor module comprises a casing 22 formed of a rigid material, say metal, or other durable material such as reinforced Kevlar™ or other composite material. The casing comprises a front wall 24, a rear wall 26, (the latter being an option) and a plurality of cassettes designated 30, 32, 34, 36 and 38.

As illustrated with reference to topmost and bottom most cassettes 30 and 38 respectively, each of the cassettes comprises a top base plate designated with the respective number of the cassette and an indication A and a bottom base plate indicated with a B, both plates being made of hard inert material, typically metal. The casing 22 is constructed such that a top face thereof 40 as constituted by the top plate 30A of cassette 30 and the bottom face of the casing 22 is constituted by the bottom base plate 38B of cassette 38.

The top base plate and the bottom base plate of a casing are non-inert members made of metallic or non metallic materials. Sandwiched between top and bottom base plates of each of the cassettes there is a reactive or passive material (also referred to in the art as energetic or non-energetic material, respectively), depending on the type of the cassette which may differ between various types of passive and reactive armor cassettes as known per se.

As illustrated in FIG. 1A, the armor module 20 is in the form of a parallelogram wherein the top and bottom faces 40 and 44 and the side faces 24 and 26, respectively, are parallel. However, other arrangements are possible as well, as illustrated in the examples of FIGS. 1B and 1C.

The cassettes disposed within the casing have the general structure as in connection with FIG. 1A and are generally thus arranged for engagement with an oncoming charge P.

Figure 1B:
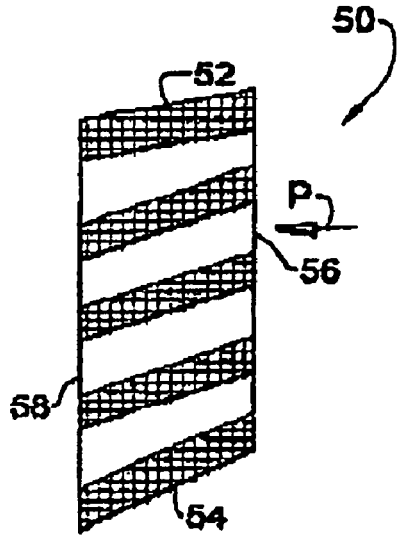

In the embodiment of FIG. 1B, there is illustrated an armor module generally designated 50 comprising the same principle structure as in FIG. 1A. However, the difference resides in that the top face 52 is parallel with the bottom face 54 whilst the front face 56 is not parallel with the rear face 58. Otherwise, and as noted, the cassettes disposed within the casing have the general structure as in connection with FIG. 1A and are generally thus arranged for engagement with an oncoming charge P.

Figure 1C:
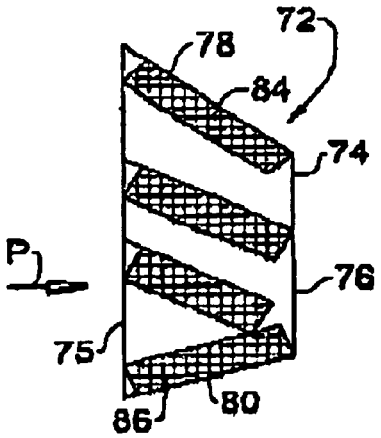

Turning now to FIG. 1C there is illustrated an armor module generally designated 72 wherein the casing 74 has a front face 75 with a rear face 76 and a top face 78 which is offset (not parallel) with respect to bottom face 80. Again, it is noticeable that the top face 78 and the bottom face 80 are constructed by a top base plate of an uppermost cassette 84 and a bottom base plate of a lowermost cassette 86, respectively.

It is further noticed that in the embodiment of FIG. 1C the plurality of cassettes disposed within the casing are arranged in a non parallel relationship. It should further be appreciated that cassettes of different types may be fixed with the same casing.

Figure 1D:
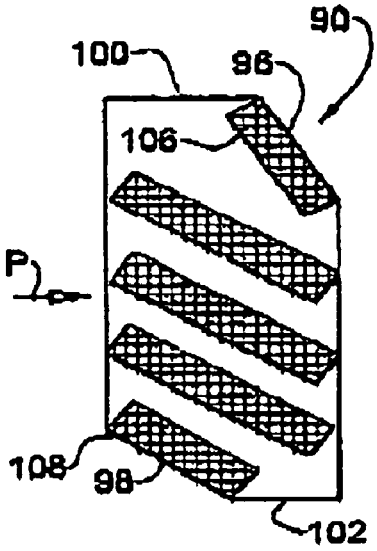

Turning now to FIG. 1D there is illustrated an armor module generally designated 90 which is principally similar to that illustrated in FIG. 1A and has the general shape of a parallelogram with the exception that both its top and bottom faces 96 and 98 are truncated at 100 and 102, respectively. It is still noted that the effective face portion of the respective top and bottom faces 96 and 98 is constituted by the respective top base plate and bottom base plate of the respective cassette 106 and 108. The outcome is that residual superfluous weight of the casing is eliminated by truncation at 100 and 102.

Figure 3:
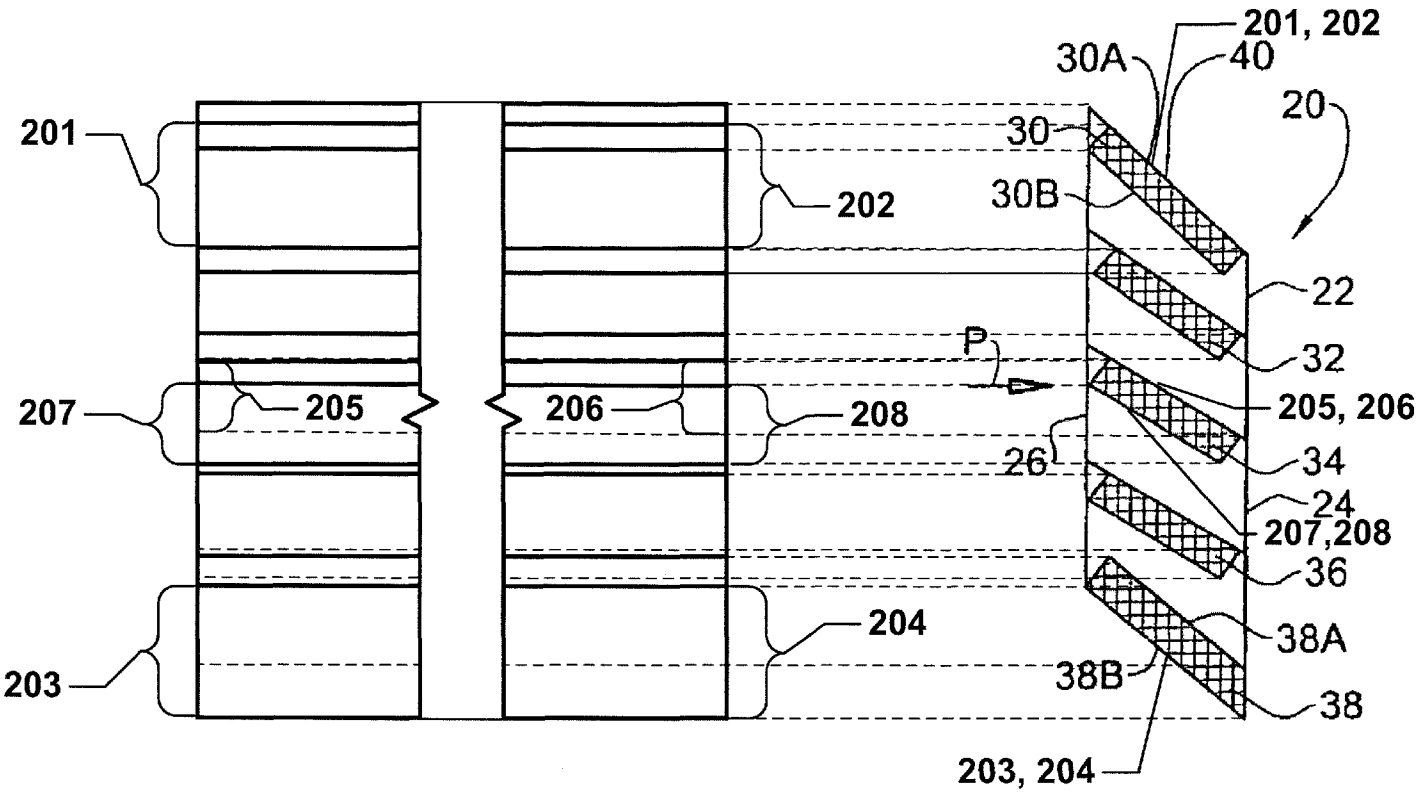
FIG. 3 is a combination of a cross-sectional view identical to FIG. 1*a* and front view wherein the transverse edges are indicated

FIG. 3 is a combination of a cross-sectional view identical to FIG. 1*a* and front view wherein the transverse edges are indicated. In the front view, front wall 26 has been removed for clarity. Leader lines of some, not all corners, connect the cross-sectional view and the front view. First through eight transverse edges 201-208, respectively, are may be disposed where each cassette ends and are indicated in the front view.

Figure 2:
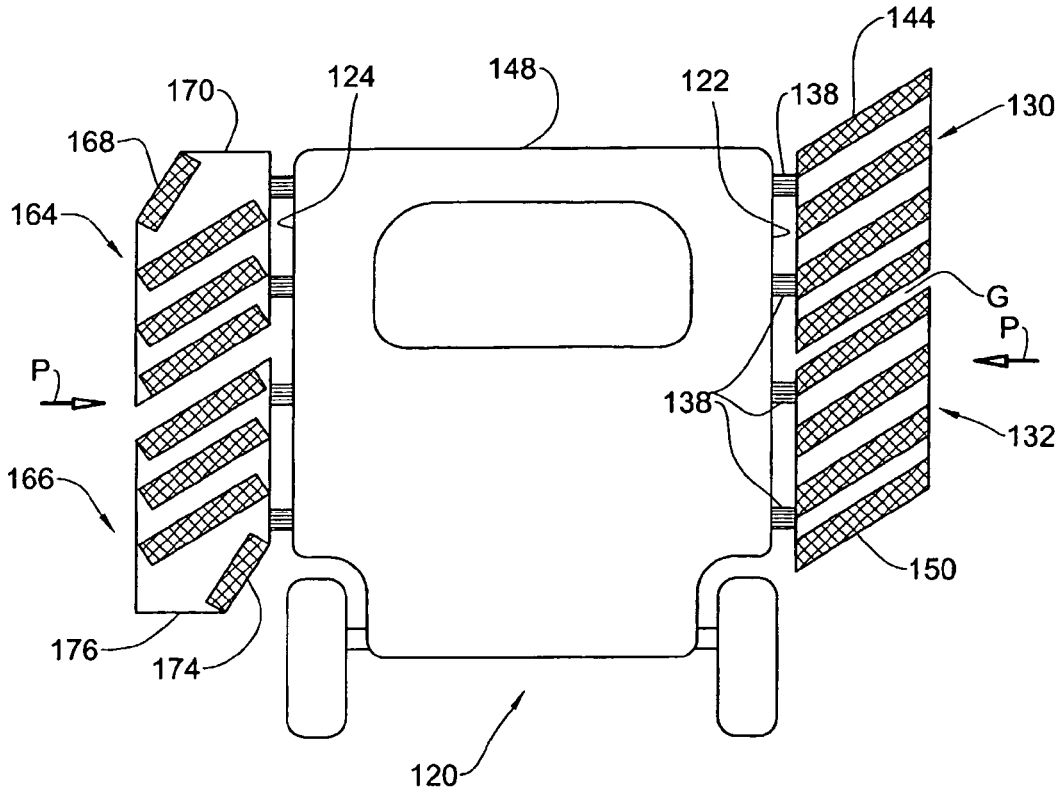
FIG. 2 is a rear view of the body, a vehicle in the particular example, fitted at two sides thereof with two different respective types of armor modules in accordance with the present invention.

Turning now to FIG. 2 there is illustrated a body to be protected, say a personnel carrier 120 having a right surface 122 and a left surface 124. Mounted on the right surface 122 are two armor modules 130 and 132 successively mounted above one another and fixed to the surface 122 by means of fixtures 138.

Fixtures 138 may be any type of fixture as known in the art which may be a fixed arrangement or an add-on type namely, suitable for retro-fit.

In the particular embodiment concerned with the right side of the vehicle, the armor module 130 and 132 correspond with the embodiment illustrated in FIG. 1A, wherein the expected oncoming projectile is generally designated by P.

It is noticed that between the top armor module 130 and the bottom armor module 132 there is a narrow gap designated G which does not provide for a normally oncoming projectile P to penetrate therebetween owing to its inclination.

Further noted, the top face 144 of the top module 130 projects beyond an upper surface 148 of the personnel carrier 120 and similarly, the lower face 150 of the bottom armor module 132 extends below the effective level of the personnel carrier 120, to thereby provide maximal protection.

Turning now to the left side of the vehicle, there is illustrated an assemblage of two armor modules 164 and 166 successively mounted above one another, the former having a top face 168 truncated at 170 and the latter having a bottom face 174 with a truncated portion 176.

The arrangement of the left side of the vehicle provides effectively the same overall ballistic effect whilst it reduces the overall weight of the armor module. Even more so, it lowers the projection of the top armor module so as to minimize interference in a line of sight where same may be required, e.g. where the top face of the armor module may interfere with the operation of firearms, etc. Similarly, the bottom armor module interferes less with grand obstacles.

As already mentioned above, one is to appreciate that various combinations of armor modules are available, as illustrated above, as well as the various combinations of cassettes which may be of any desired type.

What is claimed is:

1. An armor module comprising:

a rigid casing having a front face, a top casing face defined by first and second transverse edges, said top casing face comprising a surface that is substantially planar between said first and second transverse edges, and a bottom casing face defined by third and fourth transverse edges, said bottom casing face comprising a surface that is substantially planar between said third and fourth transverse edges; and a plurality of discrete cassettes fixedly mounted within the casing, each cassette having a generally flat top base plate and a generally flat bottom base plate, sandwiching between them at least a layer of one of an energetic material and a non-energetic material, wherein for each said cassette said top base plate thereof is defined by fifth and sixth transverse edges and a top cassette face that is substantially planar between said fifth and sixth transverse edges, and said bottom base plate thereof is defined by seventh and eighth transverse edges and a bottom cassette face that is substantially planar between said seventh and eighth transverse edges;

wherein the cassettes comprise at least an uppermost cassette, a lowermost cassette and situated therebetween at least one intermediate cassette, and wherein for at least said uppermost cassette and said lowermost cassette, the respective top base plate and the respective bottom base plate thereof are made of metal having the same general hardness; and wherein the cassettes are mounted within the casing such that the top cassette face of the uppermost cassette constitutes said top casing face and the top casing face is inclined with respect to said front face, and the bottom cassette face of the lowermost cassette constitutes said bottom casing face and the bottom casing face is inclined with respect to said front face;

wherein each of the plurality of cassettes comprises a front face, each of the plurality of cassettes being mounted within the casing at an acute angle formed between the front face of the cassette and the front face of the casing.

2. An armor module according to claim 1, wherein the top and bottom faces of the casing are parallel to one another.

3. An armor module according to claim 1, wherein the casing further comprises a rear face.

4. An armor module according to claim 3, wherein the front and rear faces of the casing are parallel to one another.

5. An armor module according to claim 3, wherein a perimeter of the casing is configured as a parallelogram.

6. An armor module according to claim 5, wherein the perimeter of the casing comprises a section of a parallelogram, with one or both of an opposing top and a bottom face being truncated for increasing durability of the casing.

7. An armor module according to claim 6, wherein a cassette corresponding with a truncated face of the casing is shorter than cassettes placed intermediately within the casing.

8. An armor module according to claim 3, wherein the rear face of the casing comprises fixtures for attaching the armor module to a body.

9. An armor module according to claim 1, being an add-on type.

10. An armor module according to claim 1, wherein the cassettes are mounted within the casing in a non-parallel relationship.

11. An armor module according to claim 1, wherein the cassettes are mounted within the casing in a parallel relationship.

12. An armor module according to claim 1, wherein the cassettes are mounted within the casing askew with respect to the front face of the casing.

13. An armor module according to claim 1, wherein the cassettes are selected from a group comprising reactive armor cassettes and passive armor cassettes and combined passive/reactive cassettes.

14. The armor module of claim 1, wherein the armor module comprises at least two said intermediate cassettes situated between the uppermost cassette and the lowermost cassette.

15. An armor module according to claim 1, wherein at least for said uppermost cassette and said lowermost cassette, the corresponding top base plate and bottom base plate of each said cassette is made from a similar generally inert material.

16. A casing for an armor module, the casing comprising:

a rigid material, a front face, a top casing face defining a top of the casing, and a bottom casing face defining a bottom of the casing;

a plurality of planar cassettes fixedly mounted within the casing;

wherein each cassette comprises a generally flat top base plate and a generally flat bottom base plate, sandwiching between them at least a layer of one of an energetic material and a non-energetic material;

wherein the cassettes comprise at least an uppermost cassette and a lowermost cassette and situated therebetween at least one intermediate cassette; wherein for at least said uppermost cassette and said lowermost cassette, the respective top base plate and the respective bottom base plate thereof are made of metal having the same general hardness;

wherein the top casing face is defined by first and second transverse edges, said top casing face comprising a top casing surface that is substantially planar between said first and second transverse edges, and wherein the bottom casing face is defined by third and fourth transverse edges, said bottom casing face comprising a bottom casing surface that is substantially planar between said third and fourth transverse edges; and wherein the cassettes are mounted within the casing such that the top cassette face of the uppermost cassette constitutes said top casing face and the top casing surface is inclined with respect to said front face, and the bottom cassette face of the lowermost cassette constitutes said bottom casing face and the bottom casing surface is inclined with respect to said front face;

wherein each of the plurality of cassettes comprises a front face, each of the plurality of cassettes being mounted within the casing at an acute angle formed between the front face of the cassette and the front face of the casing.

17. A casing according to claim 16, wherein said casing further comprises a rear face.

18. A casing according to claim 17, wherein the front and rear faces of the casing are parallel to one another.

19. A casing according to claim 17, wherein the rear face comprises fixtures for attaching the armor module to a body.

20. A casing according to claim 16, wherein the top and bottom faces of the casing are parallel to one another.

21. A casing according to claim 16, wherein the casing is an add-on type.

22. The casing for an armor module of claim 16, comprising at least two said intermediate cassettes situated between the uppermost cassette and the lowermost cassette.

23. An armor module comprising:

a front face, a top of the casing defining a top of the armor module; and a bottom of the casing defining a bottom face armor module;

wherein a plurality of spaced apart planar cassettes are fixedly mounted within the casing; each cassette having a generally flat top base plate and a generally flat bottom base plate, sandwiching between them at least a layer of one of an energetic material and a non-energetic material;

wherein the cassettes comprise at least one uppermost cassette and one lowermost cassette, wherein for at least said uppermost cassette and said lowermost cassette, the respective top base plate and the respective bottom base plate thereof are made of metal having the same general hardness;

wherein the top of the casing is defined by first and second transverse edges, said top of the casing comprising a top casing surface that is substantially planar between said first and second transverse edges, and wherein the bottom of the casing is defined by third and fourth transverse edges, said bottom of the casing comprising a bottom casing surface that is substantially planar between said third and fourth transverse edges; and wherein the cassettes are mounted within the casing such that the top base plate of the uppermost cassette constitutes said top of the casing and the top casing surface is inclined with respect to said front face, and the bottom base plate of the lowermost cassette constitutes said bottom of the casing and the bottom casing surface is inclined with respect to said front face wherein each of the plurality of cassettes comprises a front face, each of the plurality of cassettes being mounted within the casing at an acute angle formed between the front face of the cassette and the front face of the casing.

24. The casing for an armor module of claim 23, comprising at least two said intermediate cassettes situated between the uppermost cassette and the lowermost cassette.

25. An armor module comprising:

a rigid casing having a front face, a top face defining a top of the casing and a bottom face defining a bottom of the casing, wherein a plurality of planar cassettes are fixedly mounted within the casing; each cassette having a top base plate and a bottom base plate, sandwiching between them a layer of an energetic material;

wherein the cassettes comprise at least the uppermost cassette and a lowermost cassette and situated therebetween at least one intermediate cassette, wherein for at least said uppermost cassette and said lowermost cassette, the respective top base plate and the respective bottom base plate thereof are made of metal having the same general hardness;

wherein the cassettes are mounted within the casing in an inclined manner with respect to said front face such that the top face comprises the top base plate of the uppermost cassette, and the bottom face comprises the bottom base plate of the lowermost cassette;

wherein each of the plurality of cassettes comprises a front face, each of the plurality of cassettes being mounted within the casing at an acute angle formed between the front face of the cassette and the front face of the casing.

26. An armor module for protecting a vehicle from a charged projectile, the module comprising:

a plurality of spaced-apart planar cassettes mounted parallel to each other in a casing inclined at an angle with respect to a front face of the casing, each cassette comprising a bottom plate and a top plate with an energetic material disposed therebetween to dissipate the force of the charged projectile upon impact of the projectiles;

wherein the top plate of the uppermost cassette is the top planar surface of the module and the bottom plate of the lowermost cassette is a bottom planar surface of the module;

wherein at least said uppermost cassette and said lowermost cassette, the respective top base plate and the respective bottom base plate thereof are made of metal having the same general hardness;

wherein each of the plurality of cassettes comprises a front face, each of the plurality of cassettes being mounted within the casing at an acute angle formed between the front face of the cassette and the front face of the casing.

27. An armor module comprising:

a rigid casing having a front face, a top casing face defining a top of the casing, and a bottom casing face defining a bottom of the casing; and a plurality of discrete cassettes fixedly mounted within the casing, each cassette having a generally flat top base plate and a generally flat bottom base plate, sandwiching between them at least a layer of one of an energetic material and a non-energetic material, wherein for each said cassette said top base plate thereof is defined by first and second transverse edges and a top cassette face that is substantially planar between said first and second transverse edges, and said bottom base plate thereof is defined by third and fourth transverse edges and a bottom cassette face that is substantially planar between said third and fourth transverse edges;

wherein the cassettes comprise at least an uppermost cassette, a lowermost cassette and situated therebetween at least one intermediate cassette, and wherein for at least said uppermost cassette and said lowermost cassette, the respective top base plate and the respective bottom base plate thereof are made of metal having the same general hardness; and wherein the cassettes are mounted within the casing such that the top cassette face of the uppermost cassette constitutes said top casing face and the top cassette face is inclined with respect to said front face, and the bottom cassette face of the lowermost cassette constitutes said bottom casing face and the bottom cassette face is inclined with respect to said front face;

wherein each of the plurality of cassettes comprises a front face, each of the plurality of cassettes being mounted within the casing at an acute angle formed between the front face of the cassette and the front face of the casing.

28. An armor module comprising:

a rigid casing having a front face, a top casing face defined by first and second transverse edges, said top casing face being substantially planar between said first and second transverse edges, and a bottom casing face defined by third and fourth transverse edges, said bottom casing face being substantially planar between said third and fourth transverse edges; and a plurality of discrete cassettes fixedly mounted within the casing, each cassette having a generally flat top base plate and a generally flat bottom base plate, sandwiching between them at least a layer of one of an energetic material and a non-energetic material, wherein for each said cassette said top base plate thereof is defined by a top cassette face that is substantially planar, and said bottom base plate thereof is defined by a bottom cassette face that is substantially planar;

wherein the cassettes comprise at least an uppermost cassette, a lowermost cassette and situated therebetween at least one intermediate cassette, and wherein for at least said uppermost cassette and said lowermost cassette, the respective top base plate and the respective bottom base plate thereof are made of metal having the same general hardness; and wherein the cassettes are mounted within the casing such that the top cassette face of the uppermost cassette constitutes said top casing face and the top casing face is inclined with respect to said front face, and the bottom cassette face of the lowermost cassette constitutes said bottom casing face and the bottom casing face is inclined with respect to said front face;

wherein each of the plurality of cassettes comprises a front face, each of the plurality of cassettes being mounted within the casing at an acute angle formed between the front face of the cassette and the front face of the casing.

* * * * *